US005349141A

United States Patent [19]

Horibe et al.

[11] Patent Number: 5,349,141

[45] Date of Patent: Sep. 20, 1994

[54] RESONATOR TYPE SILENCER HAVING PLURAL RESONANCE CHAMBERS

[75] Inventors: Hidehiko Horibe, Asaka; Yuuta Usui, Sakado, both of Japan

[73] Assignee: Tsuchiya Mfg. Co., Ltd., Tokyo, Japan

[21] Appl. No.: 110,828

[22] Filed: Aug. 25, 1993

[30] Foreign Application Priority Data

Aug. 31, 1992 [JP] Japan ..... 4-066735[U]

[51] Int. Cl.[5] ..... E04F 17/04

[52] U.S. Cl. ..... 181/224; 181/227; 181/229; 181/250; 181/273; 181/276

[58] Field of Search ..... 181/224, 226, 227, 228, 181/229, 232, 236, 241, 243, 246, 250, 253, 255, 273, 276; 60/312

[56] References Cited

U.S. PATENT DOCUMENTS 1,179,075 4/1916 Collins ..... 181/227

4,539,947 9/1985 Sawada et al. ..... 60/312 X

*Primary Examiner*—Michael L. Gellner

*Assistant Examiner*—Khanh Dang

*Attorney, Agent, or Firm*—Foley & Lardner

[57] ABSTRACT

A resonator type silencer installed in an intake system of an automotive internal combustion engine. The resonator type silencer comprises a generally cup-shaped base member integrally connected with an air duct through which intake air to be inducted into the engine passes. The air duct is formed with an opening through which the inside of the base member is in communication with the inside of the air duct. The base member is formed at its opened end with a peripheral flange. A cover member is formed at its opened end with a peripheral flange which is bonded to the peripheral flange of the base member to define a sealed chamber. A partition plate is fixedly disposed inside the sealed chamber to divide the sealed chamber into a first resonance chamber defined by the base member, and a second resonance chamber defined by the cover member. The partition plate has a central section which is axially separate from a peripheral section which is fixedly put between the peripheral flanges of the base and cover members. The partition plate is formed at its central section with an opening through which the first and second resonance chambers are in communication with each other.

9 Claims, 3 Drawing Sheets

RESONATOR TYPE SILENCER HAVING PLURAL RESONANCE CHAMBERS

BACKGROUND OF THE INVENTION

1. Field of the Invention

This invention relates to improvements in a resonator type silencer having plural resonance chambers, and more particularly to such a silencer which is formed of a plastic and arranged to facilitate changing the sound attenuating characteristics without a considerable modification in its basic design.

2. Description of the Prior Art

Hitherto a variety of resonator type silencers have been proposed and put into practical use in the field of automotive internal combustion engines. The silencers are usually employed in an intake system of the engine to attenuate intake air noise. Of these silencers, there is a resonator type silencer having two resonance chambers which are communicated in series with each other in order to attenuate noise at two frequency ranges under resonance. In other words, such a silencer has a noise attenuation characteristics which has two frequency peaks to be attenuated thereby expanding a noise attenuating region of the silencer as compared with a resonance type silencer having a single resonance chamber. Such a resonance type silencer having two resonance chambers is usually installed to an intake air duct through which intake air is inducted into the engine cylinders of the engine. The silencer includes a main body which is formed thereinside with a chamber. A partition plate is provided in the chamber to divide the chamber into the two resonance chambers.

However, the partition plate of the silencer is generally flat and therefore fixed in noise attenuating characteristics. In other words, the silencer has a characteristics in which the two frequency peaks to be attenuated are fixedly set and not variable, so that the noise attenuating characteristics of the silencer is not variable without modifying a basic design thereof.

SUMMARY OF THE INVENTION

It is an object of the present invention to provide an improved resonator type silencer having two resonance chambers, which can overcome drawbacks encountered in conventional resonator type silencers having two resonance chambers.

Another object of the present invention is to provide an improved resonator type silencer having two resonance chambers, by which resonator type silencers respectively having a variety of noise attenuating characteristics can be readily obtained without a considerable modification of constituent components of the silencer even by using the same main body.

A further object of the present invention is to provide an improved resonator type silencer having two resonance chambers, by which resonator type silencers respectively having a variety of noise attenuation characteristics can be obtained by replacing a partition plate disposed inside a main body under such a structure of the main body that the partition plate is put between two separated members constituting the main body, or by changing the axial distance of the central section from the peripheral section of the partition plate.

A resonator type silencer of the present invention comprises a duct member through which a gas passes. The duct member has an opening formed through a wall thereof. A base member is securely and sealingly connected with the duct member and formed of a plastic. The base member is formed generally cup-shaped and has an end peripheral portion defining an opening. The inside of the base member is communicated with the inside of the duct member through the opening of the duct member. A generally cup-shaped cover member is formed of a plastic and has an end peripheral portion defining an opening. The end peripheral portion of the cover member is in tight contact with the end peripheral portion of the base member to form a sealed chamber. A partition plate is disposed between the base member and cover member to divide the sealed chamber into a first resonance chamber defined by the base member and a second resonance chamber defined by the cover member. The partition plate has a central section, and a peripheral section integrally connected with the central section. The central section is axially separate from the peripheral section. The peripheral section is securely put between the end peripheral portions of the base member and the cover member. The partition plate is formed at its central section with an opening through which the first and second resonance chambers are in communication with each other.

Accordingly, the resonance type silencers having respectively a variety of noise attenuating characteristics can be readily obtained only by using the partition plates having various axial distances each between the central section and the peripheral section of the partition plate or by replacing the partition plate with another one, without a considerable modification the base member and the cover member.

BRIEF DESCRIPTION OF THE DRAWINGS

In the drawings, like reference numerals designate like parts and elements throughout all figures, in which.

DETAILED DESCRIPTION OF THE INVENTION

Figure 1:
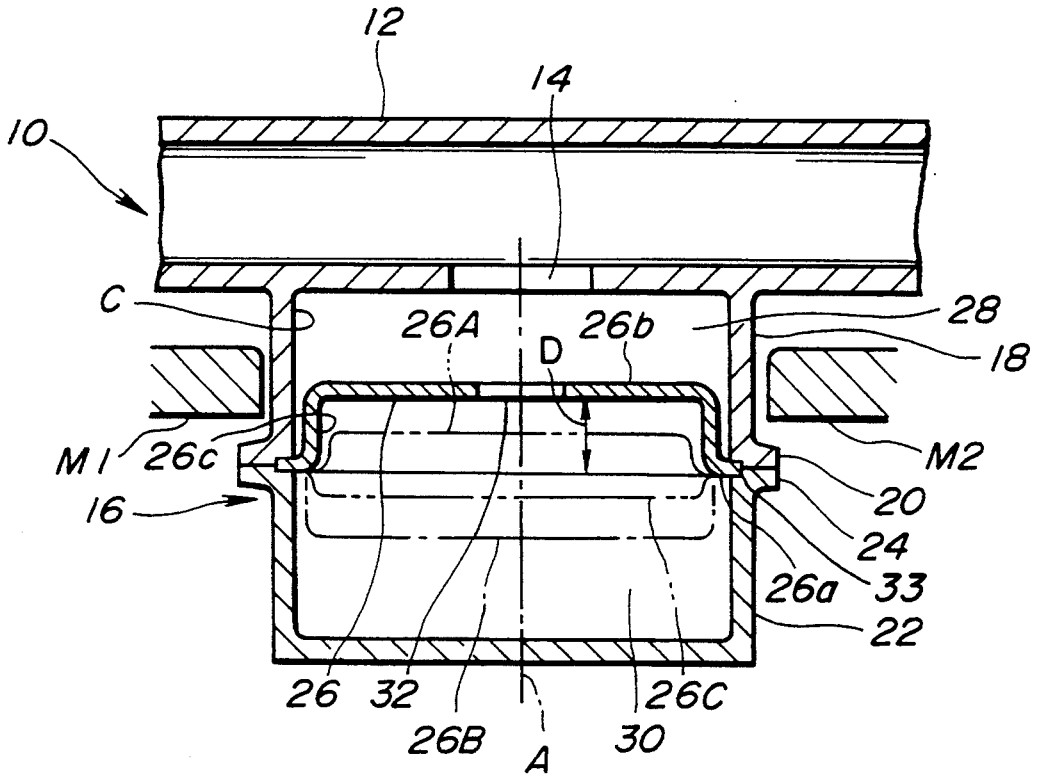
FIG. 1 is a cross-sectional view of a first embodiment of a resonator type silencer in accordance with the present invention.

Referring now to FIG. 1, a first embodiment of a resonator type silencer according to the present invention is illustrated by the reference character 10. In this embodiment, the resonator type silencer 10 is installed to an intake system of an automotive internal combustion engine (not shown) and comprises an air duct 12 which forms part of the intake system and located between an air filter (not shown) and the engine (engine cylinders). Intake air to be inducted into the engine (engine cylinders) passes through the air duct 12. The air duct 12 is formed of a plastic such as polypropylene and has an opening 14 formed through a wall thereof.

A main body 16 of the silencer 10 includes a generally cylindrical or cup-shaped base member 18 which is integral with the air duct 12 and formed surrounding the opening 14. The inside of the base member 18 is communicated through the opening 14 with the inside of the air duct 12. The base member 18 is formed at its opened lower end with a peripheral flange 20 which has a lower flat contacting surface (no numeral). The flange 20 extends laterally outwardly as shown in FIG. 1. The base member 18 is formed of a plastic such as polypropylene. A generally cup-shaped cover member 22 is formed at its opened upper end with a peripheral flange 24 which has an upper flat contacting surface (no numeral). The upper flat contacting surface of the flange 24 is tightly contactable with the lower flat contacting surface of the base member flange 20 to form an air tight chamber C defined by the base member 18 and the cover member 22. The cover member 22 is formed of a plastic such as polypropylene.

A partition plate 26 has a peripheral section 26*a* which is put between the base member 18 and the cover member 22 and located at a position near the flanges 20, 24. More specifically, grooves 33 are respectively formed at the flat contacting surfaces of the flanges 20, 24 in such a manner as to merge in the chamber C in a state the outer peripheral portion of the partition plate 26 has not yet been fitted in the groove 33. The outer peripheral portion of the peripheral section 26*a* is tightly fitted in the grooves 33, so that a major part of the partition plate 26 is fixedly disposed inside the chamber C defined by the base and cover members 18, 22. The partition plate 26 divides the chamber C into a first resonance chamber 28 defined by the base member 18, and a second resonance chamber 30 defined by the cover member 22. The partition plate 26 has a central section 26*b* which is separate or spaced from the peripheral section 26*a* in the direction of an axis A of the main body 16. The axis A is perpendicular to a plane (not shown) flush with the flat contacting surfaces of the flanges 20, 24. In other words, the central section 26*b* is separate or spaced by a distance D from the above-mentioned plane. As shown, the central section 26*b* is generally flat and integral with the peripheral section 26*a* through a generally cylindrical connecting section 26*c*. The central section 26*b* is formed at its central part with an opening 32 through which the first and second resonance chambers 28, 30 are communicated with each other. The partition plate 26 is formed of a plastic such as polypropylene. The flanges 20, 24 of the base and cover members 18, 22 and the peripheral section 26*a* of the partition plate 26 are fastened to each other by welding, in which they are molten and merged with each other so that the boundary surfaces among them are not clear though the boundary surfaces are indicated in FIG. 1 for the purpose of assisting the understanding of the present invention.

with the thus arranged resonator type silencer 10, attenuation of noise due to intake air in the intake system is made as follows: Assuming that the resonance chambers 28, 30 have volumes V1, V2, respectively, noise (sound wave) having a natural frequency decided corresponding to the total volume of V1 + V2 makes its resonance at the first resonance chamber 28 and is trapped therein, whereas noise (sound wave) having a natural frequency decided corresponding to the volume V2 makes its resonance at the second resonance chamber 30 and trapped therein. Thus, according to the above embodiment, two frequency ranges of air intake noise can be effectively attenuated under the action of resonance.

It will be appreciated that the partition plate 26 may be replaced with another partition plate represented by a line 26A, 26B, 26C (indicating the center line in section). The partition plate (26A) has a distance D different from that of the partition plate 26. Each of the partition plates (26B, 26C) is disposed on the opposite side of the above-mentioned plane flush with the contacting surfaces of the flanges 20, 24, and has a distance D different from that of the partition plane 26. It will be understood that noise attenuating characteristics of the silencer 10 can be changed merely by replacing the partition plate 26 with another partition plate (26A, 26B, 26C) without no modification to the base member 18 and the cover member 22, in which the distance D is changed. Such changing in noise attenuating characteristics can be also made by reversing the same partition plate with respect to the above-mentioned plane. Additionally, the partition plate 26 of the generally cup-shape is high in rigidity and therefore contributes to increasing a vibration resistance of the silencer 10 as compared with a flat partition plate used in a conventional resonator type silencer having two resonance chambers.

Furthermore, in case that members M1, M2 such as engine accessories are located near the outer surface of the base member 18 so as to interfere with the outwardly projecting flanges 20, 24 of the base and cover members 18, 22, the location of the flanges 20, 24 can be selected so that the flanges do not interfere with the members M1, M2, without changing the volume ratio of the first and second resonance chambers 28, 30. This is because, in this embodiment, the volume ratio of the first and second resonance chambers 28, 30 are determined by the partition plate 26 regardless of the location of the flanges 20, 24 of the base and cover members 18, 22. Thus, according to the structure of the silencer of this embodiment, the silencer can be installed at a required location even in a relatively narrow engine compartment.

Figure 2:
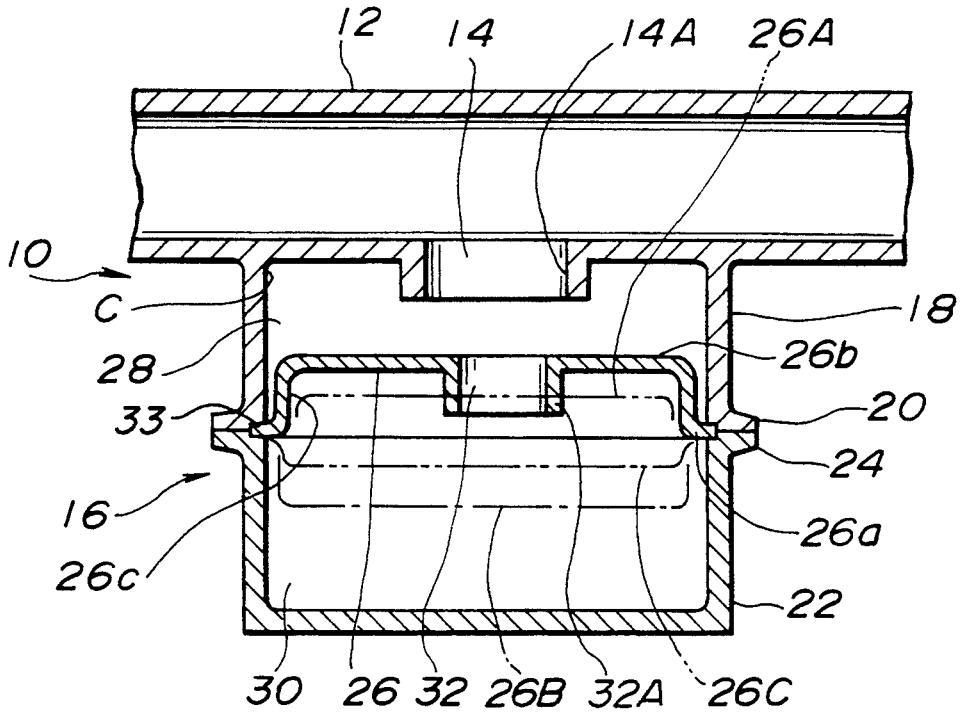
FIG. 2 is a cross-sectional view of a second embodiment of the resonator type silencer in accordance with the present invention.

FIG. 2 illustrates a second embodiment of the resonator type silencer according to the present invention, which is similar to the first embodiment except for first and second downwardly extending cylindrical projections 14A, 32A. In this embodiment, the first downwardly extending cylindrical projection 14A is formed integral with the air duct 12 and formed surrounding the opening 14. The cylindrical projection 14A projects into the first resonance chamber 28. The second downwardly extending cylindrical projection 32A is formed integral with the central section 26*b* of the partition plate 26 and formed surrounding the opening 32. The cylindrical projection 32A projects into the second resonance chamber 30. It will be understood that these cylindrical projections 14A, 32A contribute to obtain a desired noise attenuating characteristics of the silencer 10.

Figure 3:
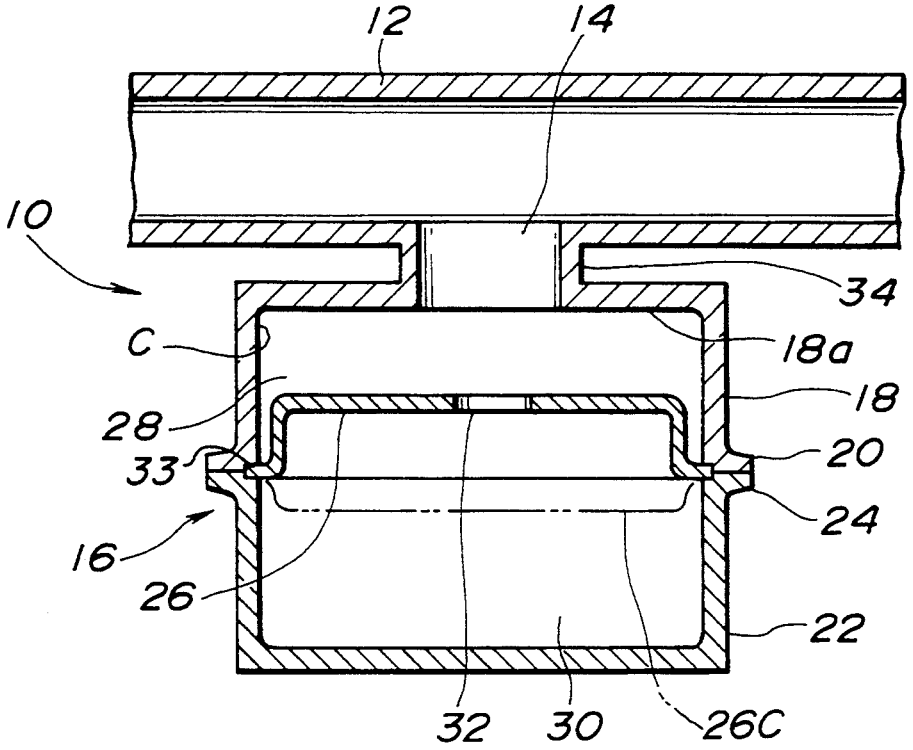
FIG. 3 is a cross-sectional view of a third embodiment of the resonator type silencer in accordance with the present invention.

FIG. 3 illustrates a third embodiment of the resonator type silencer 10 according to the present invention, similar to the first embodiment except for a cylindrical neck section 34 connecting the air duct 12 and the main body 16 of the silencer 10. In this embodiment, the base member 18 is formed cup-shaped and disposed in such a manner that an upper wall 18*a* is separate from the air duct 12. The upper wall 18*a* is formed with an opening 18*b* facing the opening 14 of the air duct 12. The cylindrical neck section 34 is located to integrally connect the air duct 12 and the upper wall 18*a* of the base member 18 and located surrounding the openings 14 and 18*b*.

It will be understood that the cylindrical neck section 34 contributes to obtain a desired noise attenuating characteristics of the silencer 10.

Figure 4:
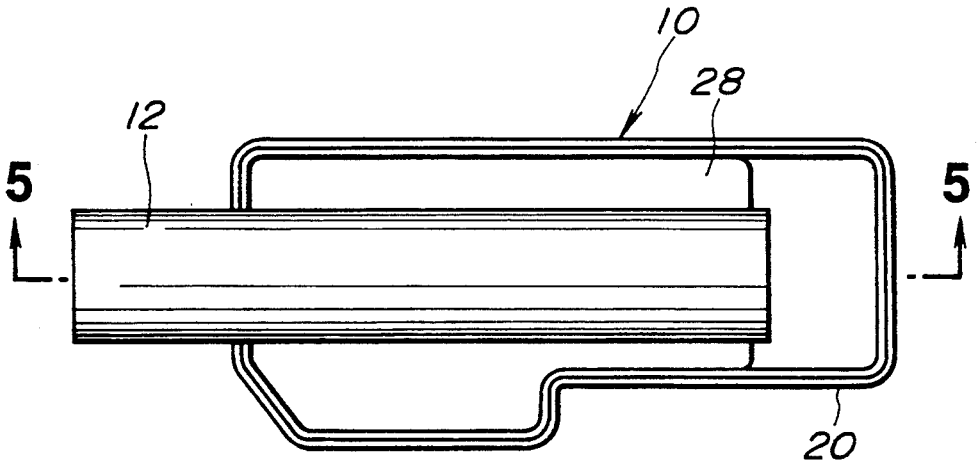
FIG. 4 is a plan view of a fourth embodiment of the resonator type silencer in accordance with the present invention.
Figure 5:
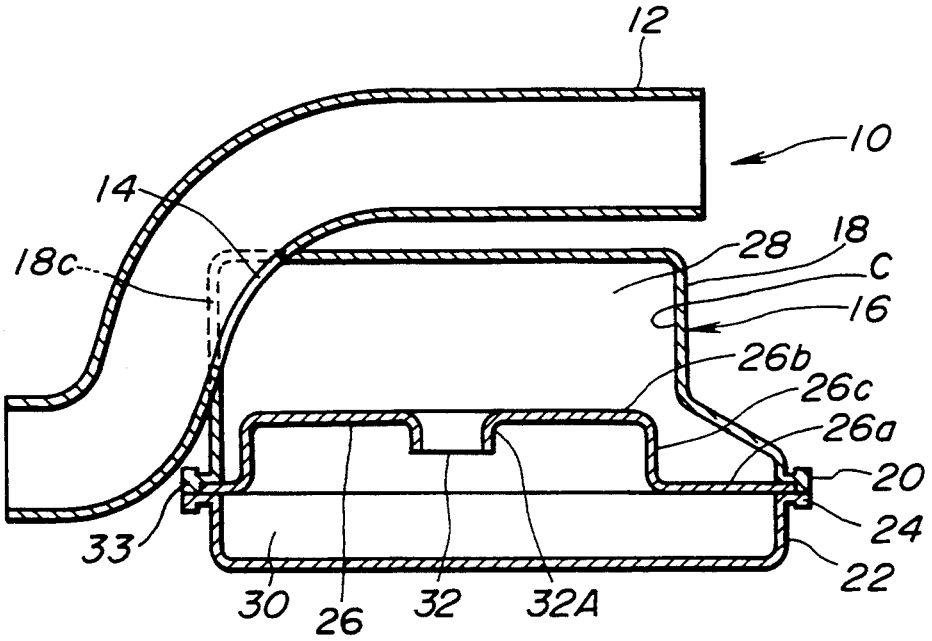
FIG. 5 is a sectional view taken in the direction of arrows and substantially along the line 5—5 of FIG. 4.

FIGS. 4 and 5 illustrate a fourth embodiment of the resonator type silencer in accordance with the present invention, which is similar to the first embodiment. In this embodiment, the air duct 12 is formed curved to be generally S-shaped. The generally cup-shaped base member 18 is formed with a cutout 18*c* which is located at an upper corner thereof and fits with the opening 14 of the air duct 12 to maintain an air-tight seal between the base member 18 and the air duct 12. For this purpose, the base member 18 and the air duct 12 are bonded with each other under welding. It is matter of course that the base member 18 and the air duct 12 are securely supported to other stationary members (parts of the engines) thereby preventing the base member 18 from detaching from the air duct 12 even under vibration. In this embodiment, the partition plate 26 is integrally formed with the downwardly extending cylindrical projection 32A as same as that in the second embodiment. Additionally, the outer peripheral portion of the peripheral section 26*a* of the partition plate 26 is fitted in a groove 33 formed only at the flat contacting surface of the flange 20 of the base member 18, the groove 33 merging in the chamber C in a state the outer peripheral portion of the partition plate 26 has not yet fitted in the groove 33. In this embodiment, the outer peripheral portion of the partition plate 26 is put between the flanges 20, 24 of the base member 18 and the cover member 22.

While the silencer 10 has been shown and described as being employed in the intake system of the internal combustion engine to attenuate intake air noise, it will be appreciated that the silencer 10 may be used in an air intake system of other machines such as an air compressor, and also used in an exhaust system of an internal combustion engine to attenuate exhaust gas noise by forming the silencer of a heat-resistant plastic.

Although the silencer 10 has been shown and described as having flanges 20, 24 for securely connecting the base member 18 and the cover member 22, it will be understood that at least one of flanges 20, 24 may be omitted; for example, in case that the side wall of the base member 18 and/or the cover member 22 is formed thick.

What is claimed is:

1. A resonator type silencer, comprising:

a duct member through which a gas passes, said duct member having an opening formed through a wall thereof;

a base member securely and sealingly connected with said duct member and formed of a plastic, said base member being formed generally cup-shaped and having an end peripheral portion defining an opening, an inside of said base member being communicated with an inside of said duct member through the opening of said duct member;

a generally cup-shaped cover member formed of a plastic and having an end peripheral portion defining an opening, the end peripheral portion of said cover member being in tight contact with the end peripheral portion of said base member to form a sealed chamber; and a partition plate disposed between said base member and cover member to divide said sealed chamber into a first resonance chamber defined by said base member and a second resonance chamber defined by said cover member, said partition plate having a central section, and a peripheral section integrally connected with said central section, said central section being axially separate from said peripheral section, said peripheral section being securely put between the end peripheral portions of the said base member and said cover member, said partition plate being formed at its central section with an opening through which said first and second resonance chambers are in communication with each other.

2. A resonator type silencer as claimed in claim 1, wherein said base member is formed at its end peripheral portion with a first flange, and said cover member is formed at its end peripheral portion with a second flange, wherein said first and second flanges respectively project outwardly from an outer surface of said base and cover member and are in tight contact with each other.

3. A resonator type silencer as claimed in claim 1, wherein at least one of said base member and said cover member is formed at said end peripheral portion with a groove in which the peripheral section of said partition plate is fitted.

4. A resonator type silencer as claimed in claim 2, wherein the peripheral section of said partition plate being put between said first and second flanges.

5. A resonator type silencer as claimed in claim 1, wherein said duct member is formed of a plastic which is the same as that of said base member, wherein said base member is integrally connected with said duct member.

6. A resonator type silencer as claimed in claim 1, wherein said plastic of said cover member is the same as that of said base member.

7. A resonator type silencer as claimed in claim 1, wherein said partition plate is formed of a plastic which is the same as that of said base member and said cover member.

8. A resonator type silencer as claimed in claim 2, wherein said first and second flanges and said partition plate are bonded with each other by welding.

9. A resonator type silencer as claimed in claim 1, wherein said duct member is an air duct through which intake air to be supplied to an internal combustion engine flows.

* * * * *